US010526993B2

(12) United States Patent
Agnus et al.

(10) Patent No.: US 10,526,993 B2
(45) Date of Patent: Jan. 7, 2020

(54) METHOD FOR CHECKING THE OPERATION OF A HIGH-PRESSURE FUEL SUPPLY UNIT FOR AN INTERNAL COMBUSTION ENGINE

(71) Applicants: Continental Automotive France, Toulouse (FR); Continental Automotive GmbH, Hannover (DE)

(72) Inventors: Yves Agnus, Toulouse (FR); Renaud Andre, Toulouse (FR); Nicolas Girard, Carbonne (FR)

(73) Assignees: Continental Automotive France, Toulouse (FR); Continental Automotive GmbH, Hannover (DE)

( * ) Notice: Subject to any disclaimer, the term of this patent is extended or adjusted under 35 U.S.C. 154(b) by 9 days.

(21) Appl. No.: 15/770,627

(22) PCT Filed: Oct. 20, 2016

(86) PCT No.: PCT/EP2016/001737
§ 371 (c)(1),
(2) Date: Apr. 24, 2018

(87) PCT Pub. No.: WO2017/071797
PCT Pub. Date: May 4, 2017

(65) Prior Publication Data

US 2019/0063362 A1 Feb. 28, 2019

(30) Foreign Application Priority Data

Oct. 29, 2015 (FR) ..... 15 60341

(51) Int. Cl.
*F02D 41/38* (2006.01)
*F02D 41/22* (2006.01)
*F02D 41/24* (2006.01)

(52) U.S. Cl.
CPC ..... *F02D 41/3845* (2013.01); *F02D 41/22* (2013.01); *F02D 41/221* (2013.01);
(Continued)

(58) Field of Classification Search
CPC ..... F02D 41/22; F02D 41/221; F02D 41/24; F02D 41/2477; F02D 41/38;
(Continued)

(56) References Cited

U.S. PATENT DOCUMENTS 5,413,079 A * 5/1995 Laufer ..... F02D 1/183 123/179.17
5,615,656 A * 4/1997 Mathis ..... F02D 41/3827 123/447
(Continued)

FOREIGN PATENT DOCUMENTS

CN 102562336 B 1/2014
DE 10136706 A1 2/2002
(Continued)

OTHER PUBLICATIONS

International Search Report and Written Opinion for International Application No. PCT/EP2016/001737, dated Jan. 20, 2017, 7 pages.

*Primary Examiner* — John Kwon
*Assistant Examiner* — Johnny H Hoang
(74) *Attorney, Agent, or Firm* — RatnerPrestia

(57) ABSTRACT

A method for checking the operation of a high-pressure fuel supply unit for an internal combustion engine, consisting in driving a high-pressure fuel injection pump by a starter, and after the engine is synchronised and fuel injection into the cylinders is shut off, in defining an initial base pressure in a high-pressure rail, in activating the injection pump by issuing successive timing and angle-setting commands, on the basis of the initial pressure, and in comparing the first pressure and the second pressure obtained in the rail by these timing and angle-setting commands, and/or by comparing at least one of the pressures with a reference pressure in order to check the operation of the high-pressure fuel supply unit for the internal combustion engine.

10 Claims, 3 Drawing Sheets

(52) U.S. Cl.
CPC ..... *F02D 41/2477* (2013.01); *F02D 41/3863* (2013.01); *F02D 2041/224* (2013.01); *F02D 2200/0602* (2013.01)

(58) Field of Classification Search
CPC ..... F02D 41/3845; F02D 41/3863; F02D 2041/224; F02D 2200/06; F02D 2200/062
USPC ..... 123/456, 458, 490, 495–499, 198 C, 123/198 DB, 198 F; 701/103, 104, 112, 701/114
See application file for complete search history.

(56) References Cited

U.S. PATENT DOCUMENTS

2005/0103312 A1* 5/2005 Uchiyama ..... F02D 41/221 123/457
2005/0103313 A1* 5/2005 Lemoure ..... F02D 41/3082 123/458
2006/0147317 A1* 7/2006 Okamoto ..... F02D 41/3845 417/297
2009/0007885 A1* 1/2009 Serra ..... F02M 63/0215 123/456
2009/0055082 A1* 2/2009 Ikeda ..... F02D 41/3845 701/104
2009/0205413 A1* 8/2009 Yamauchi ..... F02M 65/003 73/114.41
2010/0280744 A1 11/2010 Aubourg
2011/0116938 A1 5/2011 Jung et al.
2014/0283790 A1* 9/2014 Suzuki ..... F02M 63/0275 123/456
2014/0373812 A1* 12/2014 Hashim ..... F02D 41/3863 123/445
2017/0350341 A1* 12/2017 Courtiel ..... F02D 41/062
2018/0128188 A1* 5/2018 Hirata ..... F02M 51/04

FOREIGN PATENT DOCUMENTS

DE 102012218766 A1 4/2014
DE 102014100165 A1 7/2014
FR 2926110 A1 7/2009
KR 20110054469 A 5/2011

* cited by examiner

METHOD FOR CHECKING THE OPERATION OF A HIGH-PRESSURE FUEL SUPPLY UNIT FOR AN INTERNAL COMBUSTION ENGINE

CROSS REFERENCE TO RELATED APPLICATIONS

This application is the U.S. National Phase Application of PCT International Application No. PCT/EP2016/001737, filed Oct. 20, 2016, which claims priority to French Patent Application No. 1560341, filed Oct. 29, 2015, the contents of such applications being incorporated by reference herein.

FIELD OF THE INVENTION

The invention relates to a method for checking the operation of a high-pressure fuel supply system for an internal combustion engine comprising a booster pump, a high-pressure fuel injection pump fed by the booster pump, a regulator for the high-pressure fuel injection pump, means for activating the high-pressure fuel injection pump by means of a timing command or by means of an angle-setting command via the regulator for the high-pressure fuel injection pump and an engine control unit, a high-pressure fuel tank or common rail fed by said high-pressure fuel injection pump, means for measuring the pressure in the common rail, injectors fed with fuel by said common rail and controlled by the engine control unit to inject fuel into the cylinders of the internal combustion engine, said high-pressure fuel injection pump being capable of being driven by an electric drive means with the internal combustion engine.

BACKGROUND OF THE. INVENTION

In such a high-pressure fuel supply system, the fuel is transferred from the low-pressure fuel tank to the high-pressure fuel injection pump by means of the booster pump which operates at low pressure. The pressure of the fuel in the common rail is regulated by means of a PID (proportional, integral, derivative) controller, referred to as the high-pressure fuel injection pump regulator. This controller acts in combination with an actuator fitted to the high-pressure fuel injection pump, which makes it possible to transfer only as much fuel into the common rail as is necessary according to the amount of fuel required by the engine control unit for injection. To achieve this, this actuator includes a valve referred to as a DIV (digital interface valve), which makes it possible to transfer the desired amount of fuel into the common rail, and to return the fuel displaced by the high-pressure fuel injection pump but not desired in the common rail to a return circuit for returning the fuel to the low-pressure tank. The high-pressure fuel injection pump is for example a rotary piston pump that is continuously driven in rotation by the combustion engine. The actuator including a DIV will be referred to hereinafter as the DIV actuator.

The high-pressure fuel injection pump is subject to phasing between the one or more pistons thereof and the pistons of the combustion engine driving it, for example between a top dead center position of a piston of the engine and a top dead center position of a piston of the high-pressure fuel injection pump, so as to make it possible to regulate the exact amount of fuel transferred into the common rail with respect to the position of the crankshaft. The actuator including the DIV is activated by means of an electrical angle-setting command, referred to hereinafter by extension as an angle-setting command for the high-pressure fuel injection pump, produced with respect to a reference angle, i.e. a command issued at a precise angle on an axis of rotation of the high-pressure fuel injection pump, corresponding by construction to a position of the one or more pistons of said pump, so that the valve is closed at a precise position of the one or more pistons of this high-pressure fuel injection pump corresponding to a determined volume of fuel that it is desired to transfer into the common rail. The reference angle is generally set at the top dead center point of the high-pressure fuel injection pump and defined by calibration. The high-pressure fuel injection pump is phased by means of an initial calibration of the reference angle and then by learning this reference angle to account for the assembly and sensor tolerances, in particular in the present case of the high-pressure fuel injection pump and its mechanism of being driven by the combustion engine. If the phasing of the high-pressure fuel injection pump is incorrect, the amount of fuel transferred into the common rail is also incorrect, and consequently so is the pressure established in this rail.

The phasing of the high-pressure fuel injection pump is therefore subject to learning based, in a known manner, on the detection of the integral portion of the PID controller or regulator, in a certain angular window, by varying the theoretical position of the top dead center (TDC) of the high-pressure fuel injection pump. This operation of learning the phasing is performed by the engine control unit.

The electrical-control of the DIV actuator is therefore calibrated so that the electric pulse is positioned at the time of desired closure of the DIV with respect to the position of the one or more pistons of the high-pressure fuel injection pump, so that the amount of fuel determined by the engine control unit is transferred to the common rail. This electrical command of course requires knowledge of the reference angle which is set as explained above. The sequencing of the electrical command is defined during development.

Such an angle-setting command of course requires the synchronization of the engine.

Furthermore, the actuator including the DIV may be activated by means of an electrical timing command, referred to hereinafter by extension as a timing command for the high-pressure fuel injection pump, when the engine has not yet been synchronized, to make it possible to transfer fuel into the common rail before said synchronization, and hence to increase the pressure in this common rail, in particular to accelerate the engine start-up time. This timing signal generally takes the form of a squarewave PWM (pulse width modulation) electrical signal.

The high-pressure fuel injection pump is capable of being driven by an electric drive means with the internal combustion engine, for example the electric starter of the combustion engine.

The above, and in particular the learning, constitutes the elements for checking the operation of a high-pressure fuel supply system, which are known to those skilled in the art.

The maximum amount of fuel that the high-pressure fuel injection pump is able to compress depends on the angle-setting command such as explained above, determined by the regulator for said pump, and applied electrically by the engine control unit.

The performance levels of the regulator for the high-pressure fuel injection pump, of the electrical command for the actuator including the DIV, of the DIV and of said pump themselves are thus linked for the purpose of obtaining the desired result of transferring a precise amount of fuel from the high-pressure fuel injection pump to the common rail.

It is desired that the assembly of the regulator for the high-pressure fuel injection pump and of the electrical command for the actuator including the DIV is able, at any time, to load the high-pressure fuel injection pump to the maximum according to the needs of the engine control unit. There is therefore a need to ensure and to check that this maximum loading is operational. However, the following causes may distort such a check or make it difficult or even impossible:

- poor phasing of the high-pressure fuel injection pump during assembly, to such an extent that it cannot be compensated for by learning the phasing;
- poor learning of the phasing of the high-pressure fuel injection pump, for example poor learning of the top dead center of said pump;
- a fault in the electrical control of the DIV actuator, more specifically in its sequencing, ultimately regarding the actual time at which the DIV is actuated with respect to the time command issued by the regulator for the high-pressure fuel injection pump.
- improper calibration of the reference angle for the angle-setting command for the high-pressure fuel injection pump;
- abnormal consumption of fuel by the high-pressure fuel supply system leakage.

SUMMARY OF THE INVENTION

An aspect of the present invention provides a method making it possible to check the operation of a high-pressure fuel supply system for an internal combustion engine such as defined above, and in particular making it possible to:

- check the learning of the phasing of the high-pressure fuel injection pump;
- check the calculation and the application of the angle-setting command electrical signal for the actuator including the DIV;
- have information on the performance of the high-pressure fuel injection pump.

More specifically, an aspect of the present invention relates to a method for checking the operation of a high-pressure fuel supply system for an internal combustion engine comprising a booster pump, a high-pressure fuel injection pump fed by the booster pump, a regulator for the high-pressure fuel injection pump, means for activating the high-pressure fuel injection pump by means of a timing command or by means of an angle-setting command via the regulator for the high-pressure fuel injection pump and an engine control unit, a high-pressure fuel tank or common rail fed by said high-pressure fuel injection pump, means for measuring the pressure in the common rail, injectors fed with fuel by said common rail and controlled by the engine control unit to inject fuel into the cylinders of the internal combustion engine, said high-pressure fuel injection pump being capable of being driven by an electric drive means with the internal combustion engine, characterized in that the method consists in driving the high-pressure fuel injection pump by means of said electric drive means and, after the engine is synchronized and the injection of fuel into the cylinders is shut off, in defining an initial base pressure in the common rail, in successively activating the high-pressure fuel injection pump by means of said timing and angle-setting commands, respectively, on the basis of said initial base pressure, and in comparing the first pressure and the second pressure obtained in the common rail by means of said timing and angle-setting commands, respectively, with one another and/or at least one of said pressures with a reference pressure, to check the operation of the high-pressure fuel supply system for the internal combustion engine.

By comparing the amount of fuel compressed by the high-pressure fuel injection pump when the DIV actuator is controlled on the basis of angle with the amount of fuel compressed when the DIV actuator is controlled on the basis of time, it is possible to dissociate the performance of the high-pressure fuel injection pump and DIV actuator system on the one hand, from the electrical control and regulator system on the other. Specifically, the timing command is delinked from the electrical control and regulator system and provides targeted information on the high-pressure fuel injection pump and DIV actuator system, and the angle-setting command necessarily involves the electrical control and regulator system. The differences in fuel pressure measured in the common rail provide, by equivalence, the corresponding amounts of fuel injected into this rail.

This makes it possible to detect the following situations:

- poor phasing of the high-pressure fuel injection pump during assembly, to such an extent that it cannot be compensated for by learning the phasing;
- poor learning of the top dead center of the high-pressure fuel injection pump; deviation of the regulator for the high-pressure fuel injection pump, for example due to poor calibration;
- a problem in the implementation of the angle-setting command by the engine control unit;
- abnormal consumption by the high-pressure fuel supply system, or a leak in said system.

The comparison is made by measuring the difference in pressure in the common rail after one or more actions of the one or more pistons of the high-pressure fuel injection pump for each type of angle-setting and timing command.

The high-pressure fuel injection pump for implementing the method according to the invention is capable of being driven by an electric drive means with the internal combustion engine, for example the electric starter of the combustion engine.

It should be noted that according to an aspect of the invention, and unlike in the prior art, the timing command is used with the engine synchronized while its function is to actuate the high-pressure fuel injection pump when the motor is not synchronized.

According to one advantageous feature, the method according to the invention comprises the following steps:

- driving the high-pressure fuel injection pump via the electric drive means;
- waiting for the engine to be synchronized by the engine control unit;
- deactivating the injection of fuel into the cylinders by said injectors;
- defining and establishing an initial base pressure in said common rail;
- subsequently controlling the high-pressure fuel injection pump by means of one of said two timing and angle-setting commands therefor, for a first determined number of engine revolutions;
- measuring and recording a first fuel pressure obtained in the common rail on completion of said first determined number of engine revolutions by means of said one of the two timing and angle-setting commands for the high-pressure fuel injection pump;
- re-establishing said initial base pressure in said common rail;
- subsequently controlling the high-pressure fuel injection pump by means of the other of said two timing and angle-setting commands therefor, for a second determined number of engine revolutions;

measuring and recording a second fuel pressure obtained in the common rail on completion of said second determined number of engine revolutions by means of said other of said two timing and angle-setting commands for the high-pressure fuel injection pump;

comparing the first and second fuel pressures with one another and/or at least one of said pressures with a reference pressure, and using the result of the comparison to check the operation of the high-pressure fuel supply system for the internal combustion engine.

According to another advantageous feature, said first and second determined numbers of engine revolutions are identical.

According to another advantageous feature, said initial base pressure in said common rail is substantially equal to the pressure of the booster pump.

According to another advantageous feature, said reference pressure is substantially equal to the maximum pressure delivered by the high-pressure fuel injection pump.

According to another advantageous feature, the step consisting in comparing the first and second fuel pressures with one another and/or at least one of said pressures with a reference pressure, and in using the results of the comparison to check the operation of the high-pressure fuel supply system for the internal combustion engine, comprises the following steps:

comparing the first pressure with the reference pressure; and if the first pressure is lower than the reference pressure, the supply system is deemed to be non-operational; and otherwise, the timing command for the high-pressure fuel injection pump is deemed to be operational, along with the hydraulic system of said supply system.

The first pressure is chosen since the timing command is the more robust command, that is to say it is certain that the DIV has been closed at the bottom dead center of the high-pressure fuel injection pump, even in the event of an alignment error in this high-pressure fuel injection pump during reassembly thereof. The first pressure does not depend on a potentially poorly aligned angle-setting command or one in which the phasing is incorrect.

The term "hydraulic system" is understood here to mean the high-pressure fuel supply system for an internal combustion engine such as defined above, without considering the electrical elements or parts, in particular the high-pressure fuel injection pump regulator and the engine control unit, or, if applicable, the system for driving the high-pressure fuel injection pump by means of the combustion engine.

According to another advantageous feature, if the first pressure is not lower than the reference pressure, the method further includes a step consisting in comparing the first and second pressures with one another, as follows:

if the first and second pressures are equal or substantially equal, the supply system is deemed to be operational; and otherwise, the supply system is deemed to be non-operational, while having a timing command for the high-pressure fuel injection pump that is operational, along with the hydraulic system of said supply system.

The expression "first and second pressures being equal or substantially equal" is understood to mean a margin of error or range around parity which depends on the nature of the diesel or gasoline fuel under consideration.

According to another advantageous feature, if the first and second pressures are not equal or substantially equal, the method further includes the following steps:

learning the phasing of the high-pressure fuel injection pump, as explained above, and repeating the steps described above allowing new first and second pressures reached in the common rail to be obtained;

comparing the new first and second pressures with one another; and:

if the new first and second pressures reached in the common rail are equal or substantially equal, said high-pressure fuel supply system for the internal combustion engine is deemed to be operational; and if the new first and second pressures reached in the rail are not equal or substantially equal, said supply system is deemed to be non-operational with a high-pressure fuel injection pump control problem.

According to another advantageous feature, after the step consisting in having observed that the first pressure is lower than the reference pressure, and having deemed the supply system to be non-operational, the method further comprises the following steps:

comparing the first and second pressures with one another; and:

if the first and second pressures are equal or substantially equal, a leak in the high-pressure circuit is deemed to exist, or the high-pressure fuel injection pump is deemed to be ineffective or the booster pump is deemed to be ineffective;

if the first and second pressures are not equal or substantially equal, a leak in the high-pressure circuit of the system is deemed to exist, or the high-pressure fuel injection pump is deemed to be ineffective or the booster pump is deemed to be ineffective, along with a fault in the phasing of the high-pressure fuel injection pump or a fault in learning the phasing of this pump.

The expression "first and second pressures being equal or substantially equal" is understood to mean a margin of error or range around parity which depends on the nature of the diesel or gasoline fuel under consideration as well as the speed of the electric starter.

BRIEF DESCRIPTION OF THE DRAWINGS

Other features and advantages will become apparent on reading the following examples of embodiments of a method according to the invention accompanied by the appended drawings, which examples are provided by way of nonlimiting illustration.

DETAILED DESCRIPTION OF THE PREFERRED EMBODIMENTS

Figure 1:
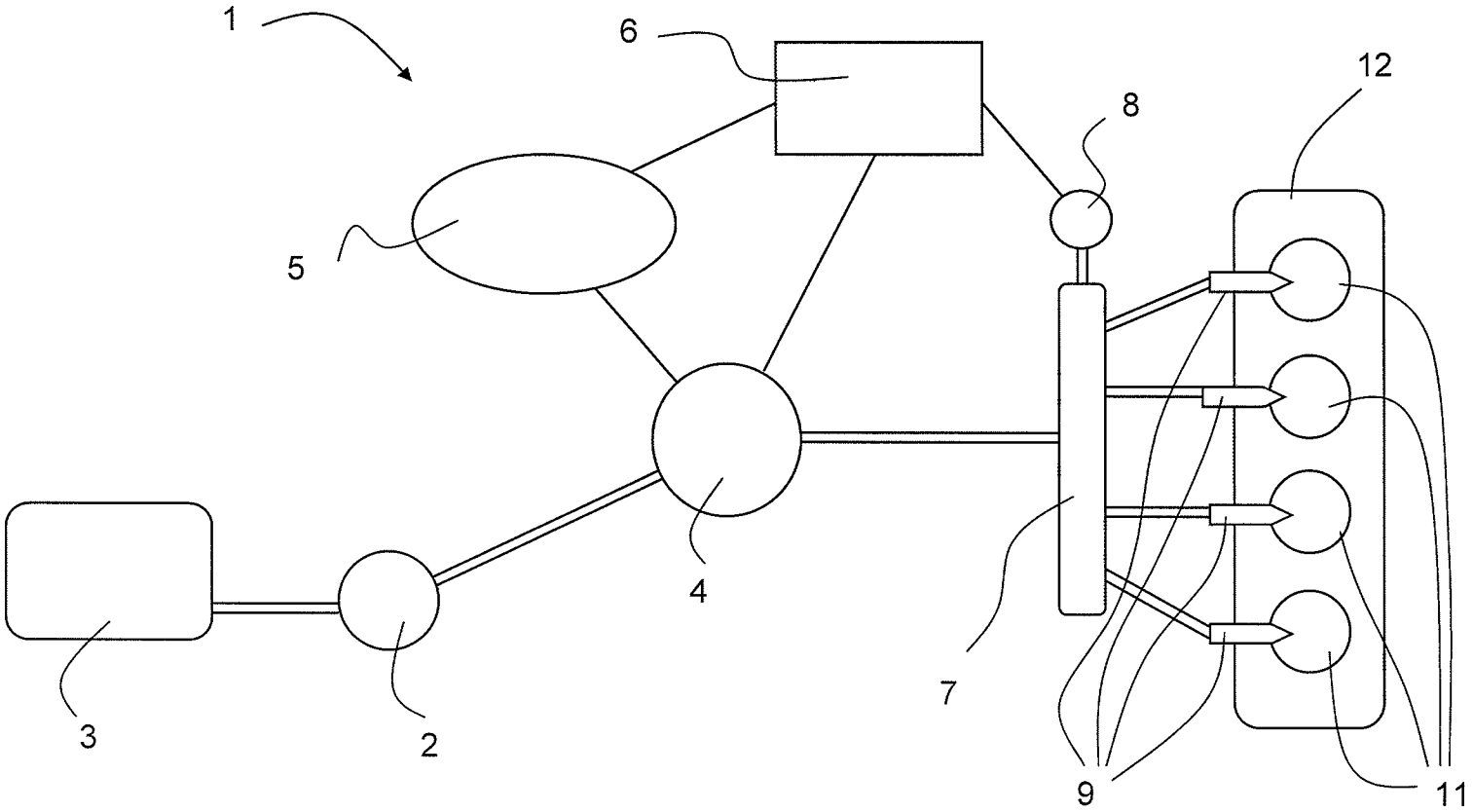
FIG. 1 shows a schematic view of one example of a high-pressure fuel supply system for an internal combustion engine, to which a method according to the invention is applied.

The high-pressure fuel supply system 1 for an internal combustion engine shown in FIG. 1 is one example of a known system. It comprises:

A booster pump 2, which takes up the low-pressure fuel held in a low-pressure fuel tank 3;

a high-pressure fuel injection pump 4 fed by the booster pump 2, and including a DIV actuator (not shown in FIG. 1) comprising a DIV such as defined above;

a regulator 5 for the high-pressure fuel injection pump 4, and more particularly for the DIV actuator;

means (not shown) for activating the high-pressure fuel injection pump by means of a timing command or by means of an angle-setting command via the regulator 5 for the high-pressure fuel injection pump 4 and an engine control unit 6;

a high-pressure fuel tank or common rail 7 fed by the high-pressure fuel injection pump 4;

means 8 for measuring the pressure in the common rail 7;

injectors 9 fed with fuel by the common rail 7 and controlled by the engine control unit 6 to inject fuel into the cylinders 11 of the internal combustion engine 12.

The hydraulic system of the fuel supply system comprises the above elements with the exception of the electrical elements or parts, in particular the regulator 5 for the high-pressure fuel injection pump 4 and the engine control unit 6. The high-pressure circuit is defined as the high-pressure fuel circuit from the high-pressure fuel injection pump 4 and downstream thereof to the injectors 9.

The high-pressure fuel injection pump 4 is capable of being driven, in a known manner, by an electric drive means (not shown) with the internal combustion engine 12, for example an electric starter or an electric machine, by virtue of a system for driving the high-pressure fuel injection pump in rotation by means of the combustion engine (not shown), for example a mechanical transmission linkage mechanism, such as a chain, gears, a belt or similar.

The method according to an aspect of the invention consists, for example, in a high-pressure fuel supply system 1 of this type, in driving the high-pressure fuel injection pump 4 by means of the electric drive means (not shown) and, after the engine 12 is synchronized and fuel injection into the cylinders 11 is shut off, in defining an initial base pressure P0 in the common rail 7, in successively activating the high-pressure fuel injection pump 4 by means of the timing and angle-setting commands, respectively, on the basis of the initial base pressure P0, and in comparing first P1 and second P2 pressures obtained in the common rail 7 by means of the timing and angle-setting commands, respectively, with one another and/or at least one of said pressures with a reference pressure Pref, to check the operation of the high-pressure fuel supply system for the internal combustion engine.

A timing command for the high-pressure fuel injection pump 4 depends on the technology of the DIV actuator, which depends on the fuel used. For example, in a known manner, a plurality of electric pulses in the form of a PWM signal is generally used for a diesel fuel, while a mean electric current is generally used for a gasoline fuel. The timing command is applied to the DIV actuator for a determined number of engine revolutions, preferably defined by a determined number of segments, one segment being equal to 720°, namely two revolutions of the engine or of the crankshaft for a four-stroke engine cycle, divided by the number of cylinders of the engine. For an internal combustion engine including four cylinders as shown in FIG. 1, one segment is equal to 180°.

An angle-setting command for the high-pressure fuel injection pump 4 is produced in a known manner by means of a plurality of electric pulses, for example of peak-and-hold or peak-hold type, for a determined number of segments such as defined above. As explained above, this angle-setting command is subject to a phasing with the high-pressure fuel injection pump 4.

A first example of an embodiment of a method according to an aspect of the invention will now be described with the aid of FIG. 2. This exemplary method is applicable in particular to a high-pressure fuel supply system 1 for an internal combustion engine such as described in FIG. 1. This method may be implemented by means of on-board software implemented in the engine control unit 6. It is used in the context of diagnostic assistance, for example using a diagnostic toolbox of known type which an operator connects to the diagnostic port of the engine control unit.

Figure 2:
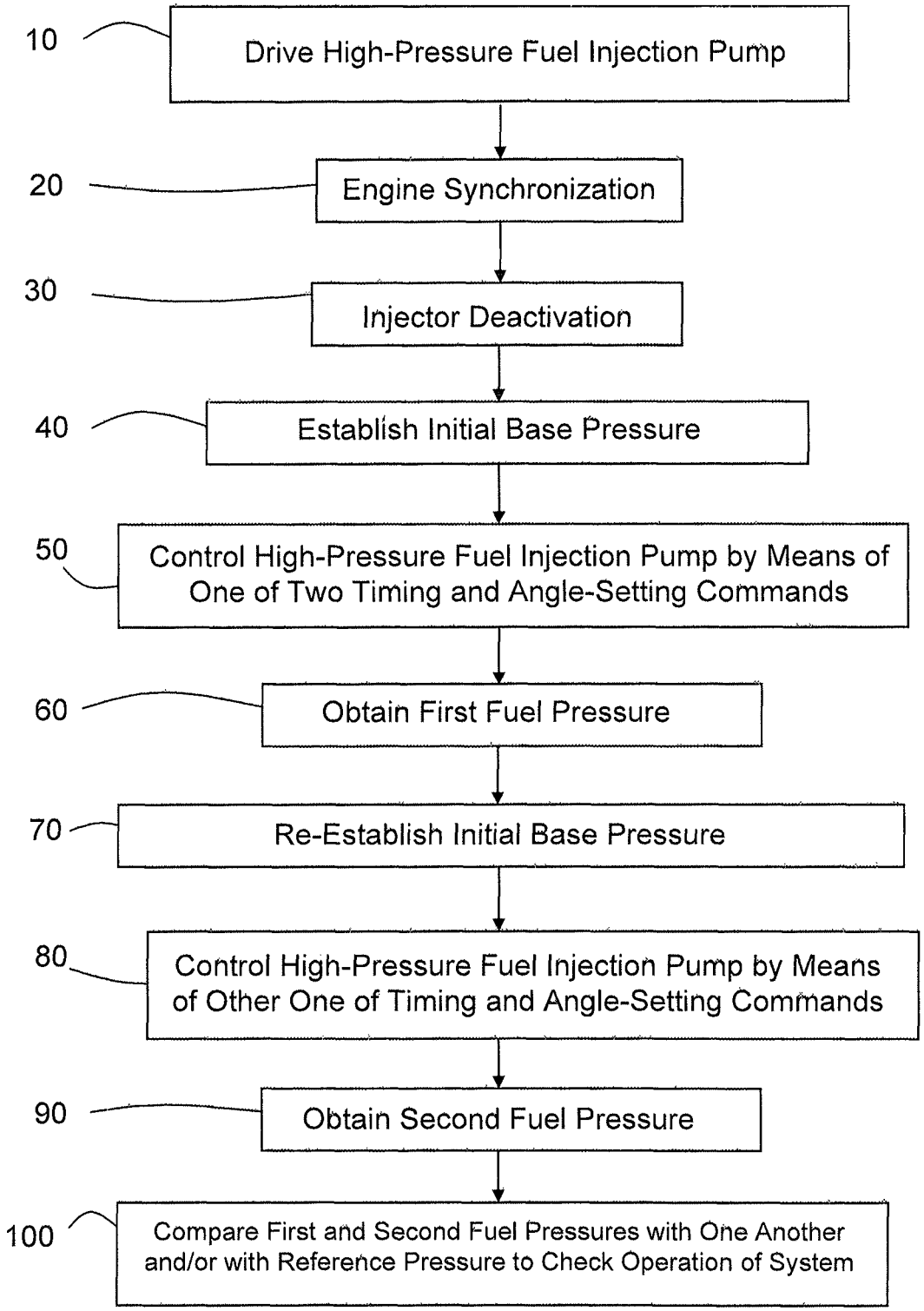
FIG. 2 shows a flow diagram of a first example of an embodiment of a method according to the invention, applied to a system according to FIG. 1.
Figure 3:
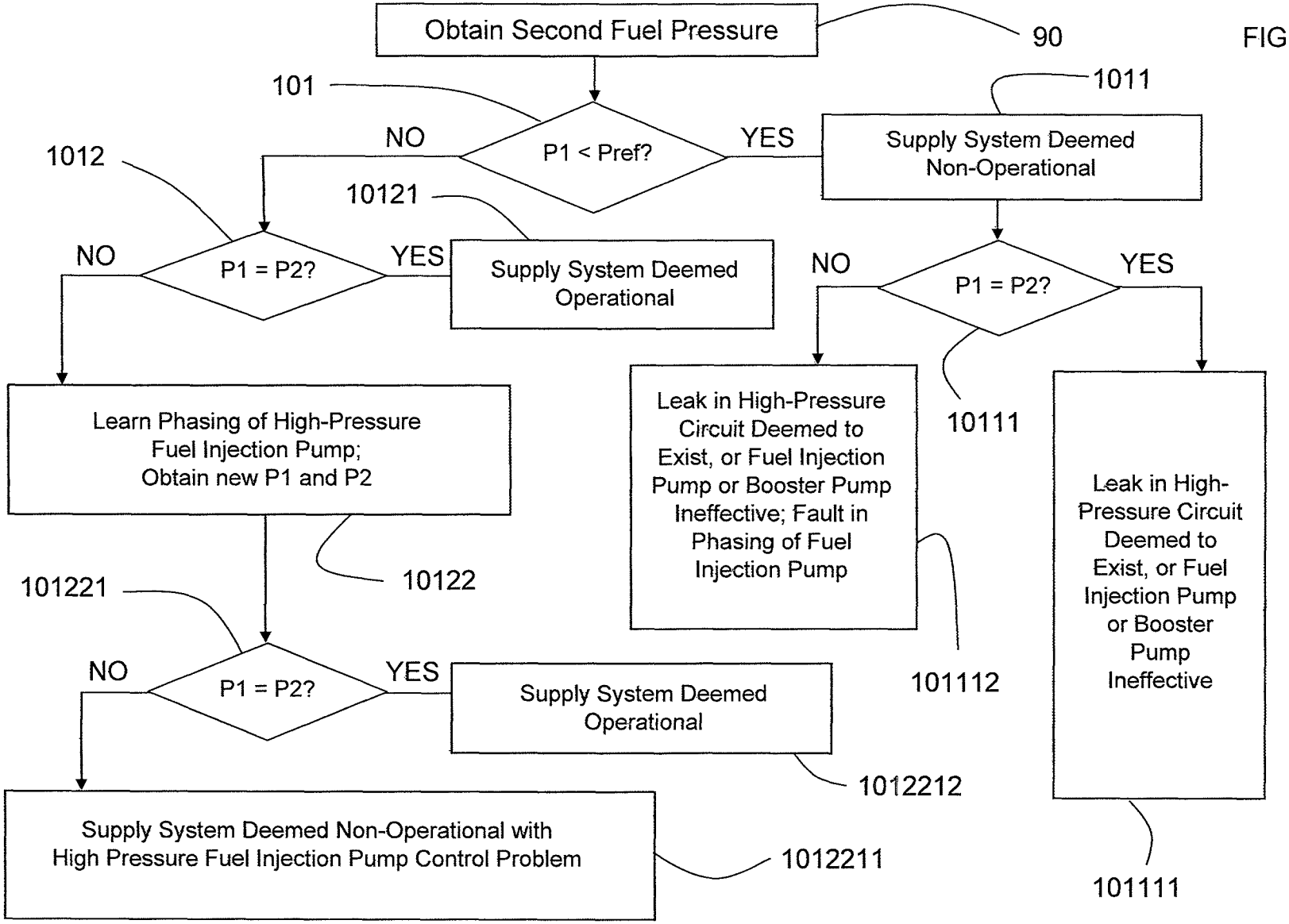
FIG. 3 shows a flow diagram including several other examples of embodiments of a method according to the invention, applied to a system according to FIG. 1.

The method for checking the operation of a high-pressure fuel supply system for an internal combustion engine according to FIG. 2 comprises the following steps:

step 10: engine at standstill, the high-pressure fuel injection pump 4 is driven via the electric drive means, for example the electric starter of the engine;

step 20: waiting for the engine 12 to be synchronized by the engine control unit 6, i.e. for the position of the crankshaft to be detected and defined within the cycles of the engine, this being carried out in any known manner, for example by means of a crankshaft position sensor (not shown);

step 30: the injection of fuel into the cylinders 11 by the injectors 9 is deactivated by closing these injectors so that, no fuel is injected into the cylinders, and by keeping them closed unless ordered otherwise in the described method;

step 40: an initial base pressure P0 is defined and established in the common rail 7; this pressure P0 is for example preferably established around the value of the booster pump 2, i.e. at the lowest possible pressure;

step 50: the high-pressure fuel injection pump 4 is subsequently controlled by means of one of the two timing and angle-setting commands therefor, for a first N1 determined number of segments, for example the timing command;

step 60: a first P1 fuel pressure obtained in the common rail on completion of said first N1 determined number of segments is measured and recorded by means of this timing command for the high-pressure fuel injection pump 4;

step 70: the initial base pressure P0 is re-established in the common rail 7, using the known existing means in the system 1 (not described above), for example for a diesel engine by virtue of a specific actuator for discharging the common rail 7 into the low-pressure tank 3, or for a gasoline engine by opening the injectors 9 solely for this purpose, the rail then being discharged into the cylinders, the injectors being closed again as soon as the pressure in the rail has dropped back down to the initial base value P0;

step 80: the high-pressure fuel injection pump 4 is subsequently controlled by means of the other command, the angle-setting command in the described example, for a second N2 determined number of segments;

step 90: a second P2 fuel pressure obtained in the common rail 7 on completion of said second N2 determined number of segments is measured and recorded by means of the angle-setting command for the high-pressure fuel injection pump 4;

step 100: the first P1 and the second P2 fuel pressures are compared with one another and/or at least one of said pressures is compared with a reference pressure Pref, and the results are used to check the operation of the high-pressure fuel supply system 1 for the internal combustion engine; for example, if P1 is equal to or substantially equal to P2, P1 and P2 being equal or substantially equal to Pref, the system is deemed to be or verified as operational, and in the opposite case is deemed to be non-operational; this step 100 will be described in greater detail below by way of other advantageous examples of embodiments, with the aid of FIG. 3.

The reference pressure Pref is preferably chosen to have a value close to the maximum pressure delivered by the high-pressure fuel injection pump 4, for a nominal operational new system, in good working condition, for example substantially equal to this maximum pressure delivered by the high-pressure fuel injection pump 4.

The numbers of segments N1, N2 are chosen such that the response of the high-pressure fuel injection pump 4 through the pressures P1, P2 reached in the common rail 7 on completion of these segments N1, N2 is as close as possible to the maximum pressure that can be obtained with the high-pressure fuel injection pump 4, hence with an angle-setting command or with a timing command. Preferably, to allow a direct comparison, the first N1 and second N2 determined numbers of segments are identical.

The initial base pressure P0 in the common rail 7 is substantially equal to the pressure of the booster pump 2, namely the lowest possible pressure, so as to increase the difference in pressure ultimately measured in the common rail 7 for the pressures P1 and P2 with respect to P0.

As shown in FIG. 3, the step consisting in comparing the first P1 and second P2 fuel pressures with one another and/or at least one of said pressures with a reference pressure Pref, and in using the results of the comparison to check the operation of the high-pressure fuel supply system for the internal combustion engine, namely step 100 in FIG. 2, advantageously comprises the following steps according to another example of embodiment:

step 101: the first pressure P1 is compared with the reference pressure Pref; and step 1011: if the first pressure P1 is lower than the reference pressure Pref, the supply system is deemed to be non-operational; the first pressure P1 is chosen since the timing command is the more robust command, that is to say it is certain that the DIV actuator has been closed at the bottom dead center of the high-pressure fuel injection pump 4, even in the event of an alignment error in this high-pressure fuel injection pump 4 during a reassembly thereof; P1 does not depend on a potentially poorly aligned angle-setting command, and otherwise, i.e. in the case in which the first pressure P1 is equal to or substantially equal to the reference pressure Pref, not being able to be higher than that in the chosen case (Pref≡±Pmax) the timing command for the high-pressure fuel injection pump is deemed to be operational, along with the hydraulic system of said supply system.

Advantageously, if the first pressure P1 is not lower than the reference pressure Pref, the method further includes a step 1012 consisting in comparing the first P1 and second P2 pressures with one another, as follows:

step 10121: if the first P1 and second P2 pressures are equal or substantially equal, the high-pressure fuel supply system for the internal combustion engine is deemed to be operational; the permissible margin of error or range around parity depends on the nature of the fuel, whether gasoline or diesel, and on the speed of the starter; and otherwise, the high-pressure fuel supply system for the internal combustion engine is deemed to be non-operational, while having a timing command for the high-pressure fuel injection pump 4 that is operational, along with the hydraulic system of the supply system.

Preferably, if the first P1 and second P2 pressures are not equal or substantially equal, the method further includes the following steps:

step 10122: the phasing of the high-pressure fuel injection pump 4 is learned, by means of a request sent to the engine control unit, and steps 10 to 90 described above are repeated to obtain new first P1 and second P2 pressures reached in the common rail 7; and step 101221: the new first P1 and second P2 pressures are compared with one another; and:

step 1012212: if the new first P1 and second P2 pressures reached in the common rail 7 are equal or substantially equal, said supply system is deemed to be operational, and hence the hydraulic fuel supply system in particular is deemed to be operational; and step 1012211: if the new first P1 and second P2 pressures reached in the common rail 7 are not equal or substantially equal, the supply system is deemed to be non-operational with a high-pressure fuel injection pump 4 control problem.

With this step 10122, the purpose is to eliminate two of the potential causes of the fault in the supply system, namely a phasing fault or a fault in learning the phasing.

In step 1012212, P1 is equal or substantially equal to P2, which are both equal or substantially equal to Pref, meaning that the system 1 is perfectly operational, the new learning operation having solved the problem raised in step 1012 resulting from the observation that P1 is not equal or substantially equal to P2.

Preferably, after step 1011 consisting in having observed that the first pressure P1 is lower than the reference pressure Pref, and having deemed the supply system to be non-operational, the method further comprises the following steps:

step 10111: the first P1 and second P2 pressures are compared with one another; and:

step 101111: if the first P1 and second P2 pressures are equal or substantially equal, a leak in the high-pressure circuit is deemed to exist, for example an injector leakage, or the high-pressure fuel injection pump 4 is ineffective or the booster pump 2 is ineffective;

step 101112: if the first P1 and second P2 pressures are not equal or substantially equal, a leak in the high-pressure circuit of the system is deemed to exist, or the high-pressure fuel injection pump is deemed to be ineffective or the booster pump is deemed to be ineffective, along with a fault in the phasing of the high-pressure fuel injection pump or a fault in learning the phasing of this pump.

In step 101111, the first P1 and second P2 pressures are equal or substantially equal, meaning that the regulator 5 is operational, the timing and angle-setting commands being operational. Thus, the regulator 5 is not the cause. However, it is recalled that these pressures P1 and P2 are lower than the reference pressure Pref as observed in prior steps 101 and 1011, which means that there is a possible unspecified fault among the three possibilities mentioned above, namely:

a leak in the high-pressure circuit, for example in the high-pressure pipes, the common rail, the PDV (pressure decay valve) or in one or more injectors, which prevents the high-pressure fuel supply pump 4 from reaching the reference pressure which is preferably chosen to have a value close to the maximum pressure delivered by the high-pressure fuel injection pump 4 for a nominal operational new system in good working order;

a fault in the high-pressure fuel injection pump 4 itself, for example due to wear, which prevents it from reaching the reference pressure as defined above;

a fault in the booster pump 2, which does not supply fuel at sufficient pressure to the high-pressure fuel injection pump 4.

In step 101112, the first P1 and second P2 pressures are not equal or substantially equal, meaning that the regulator 5 is not operational, the timing and angle-setting commands not performing identically.

This diagnosis is added to the three possible faults detected in step 101111 above.

Key for FIGS. 2 and 3:

FIG. 2:

Step 10: Drive high-pressure fuel injection pump

Step 20: Engine synchronization

Step 30: Injector deactivation

Step 40: Common rail initial base pressure P0

Step 50: High-pressure fuel injection pump timing command for N1 engine revolutions Step 60: Common rail pressure P1 measurement Step 70: Re-establish initial base pressure P0 in common rail Step 80: High-pressure fuel injection pump angle-setting command for N2 engine revolutions Step 90: Common rail pressure P2 measurement Step 100: P1, P2, Pref comparison—verify operation of high-pressure fuel supply system

FIG. 3:

Step 101: P1<Pref

Step 1011: Supply system non-operational

Step 10111: P1=P2

Step 101111: High-pressure circuit leak, or high-pressure fuel injection pump ineffective or booster pump ineffective Step 101112: High-pressure circuit leak, high-pressure fuel injection pump phasing fault Step 1012: P1=P2

Step 10121: Supply system operational

Step 10122: Learning the phasing of the high-pressure fuel injection pump, new P1, P2 values Step 101221: P1=P2

Step 1012211: Supply system non-operational, high-pressure fuel injection pump control problem Step 1012212: Supply system operational

The invention claimed is:

1. A method for checking the operation of a high-pressure fuel supply system for an internal combustion engine comprising a booster pump, a high-pressure fuel injection pump fed by the booster pump, a regulator for the high-pressure fuel injection pump, means for activating the high-pressure fuel injection pump using at least one of a timing command and an angle-setting command via the regulator for the high-pressure fuel injection pump and an engine control unit, one of a high-pressure fuel tank or a common rail, the one of the high-pressure fuel tank or the common rail configured to be fed fuel by said high-pressure fuel injection pump, injectors fed with fuel by one of the high-pressure fuel tank or the common rail and controlled by the engine control unit to inject fuel into cylinders of the internal combustion engine, said high-pressure fuel injection pump configured to be driven by an electric drive with the internal combustion engine, the method comprising:

driving the high-pressure fuel injection pump by said electric drive and, after the engine is synchronized and the injection of fuel into the cylinders is shut off, defining an initial base pressure in the one of the high-pressure fuel tank or the common rail, successively activating the high-pressure fuel injection pump by said timing and angle-setting commands, respectively, on the basis of an initial base pressure, and comparing a first pressure obtained in the one of the high-pressure fuel tank or the common rail by said timing command with a second pressure obtained in the one of the high-pressure fuel tank or the common rail by said angle-setting command and/or comparing at least one of the first pressure and the second pressure with a reference pressure, to check an operation of the high-pressure fuel supply system for the internal combustion engine.

2. The method as claimed in claimed 1, comprising:

driving the high-pressure fuel injection pump via the electric drive means;

waiting for the engine to be synchronized by the engine control unit;

deactivating the injection of fuel into the cylinders by said injectors;

defining and establishing an initial base pressure in the one of the high-pressure fuel tank, or the common rail;

subsequently controlling the high-pressure fuel injection pump using one of said two timing and angle-setting commands therefor, for a first determined number of engine revolutions;

measuring and recording a first fuel pressure obtained in the one of the high-pressure fuel tank or the common rail on completion of said first determined number of engine revolutions by said one of the two timing and angle-setting commands for the high-pressure fuel injection pump;

re-establishing said initial base pressure in paid the one of the high-pressure fuel tank or the common rail;

subsequently controlling the high-pressure fuel injection pump by the other of said two timing and angle-setting commands therefor, for a second determined number of engine revolutions;

measuring and recording a second fuel pressure obtained in the one of the high-pressure fuel tank or the common rail on completion of said second determined number of engine revolutions by said other of said two timing and angle-setting commands for the high-pressure fuel injection pump;

comparing the first and second fuel pressures with one another and/or at least one of said pressures with a reference pressure, and using the results of the comparison to check the operation of the high-pressure fuel supply system for the internal combustion engine.

3. The method as claimed in claim 2, wherein said first and second determined numbers of engine revolutions are identical.

4. The method as claimed in claim 2, wherein said initial base pressure in the one of the high-pressure fuel tank or the common rail is substantially equal to a pressure of the booster pump.

5. The method as claimed in claim 2, wherein said reference pressure is substantially equal to the maximum pressure delivered by the high-pressure fuel injection pump.

6. The method as claimed in claim 2, wherein said step (100), comprises the following steps:

comparing the first pressure with the reference pressure; and if the first pressure is lower than the reference pressure (Pref), the supply system is deemed to be non-operational; and otherwise, the timing command for the high-pressure fuel injection pump is deemed to be operational, along with a hydraulic system of said supply system.

7. The method as claimed in claim 6, wherein, if the first pressure is not lower than the reference pressure, the method further includes a step (1012) of comparing the first and second pressures with one another, as follows:

if the first and second pressures are equal or substantially equal, said supply system is deemed to be operational; and otherwise, said supply system is deemed to be non-operational, while having a timing command for the high-pressure fuel injection pump that is operational, along with a hydraulic system of said supply system.

8. The method as claimed in claim 7, wherein, if the first and second pressures are not equal or substantially equal, the method further includes the following steps:

learning the phasing of the high-pressure fuel injection pump, and repeating steps (10 to 90) allowing new first and second pressures reached in the one of the high-pressure fuel tank or the common rail to be obtained; and comparing the new first and second pressures with one another; and:

if the new first and second pressures reached in the one of the high-pressure fuel tank or the common rail are equal or substantially equal, said supply system is deemed to be operational; and if the new first and second pressures reached in the one of the high-pressure fuel, tank or the common rail are not equal or substantially equal, said supply system is deemed to be non-operational with a high-pressure fuel injection pump control problem.

9. The method as claimed in claim 6, wherein, after in having observed that the first pressure is lower than the reference pressure, and having deemed said supply system to be non-operational, the method further comprises the following steps:

comparing the first and second pressures with one another; and:

if the first and second pressures are equal or substantially equal, a leak in the high-pressure circuit is deemed to exist, or the high-pressure fuel injection pump is deemed to be ineffective or the booster pump is deemed to be ineffective;

if the first and second pressures are not equal or substantially equal, a leak in the high-pressure circuit of the system is deemed to exist, or the high-pressure fuel injection pump is deemed to be ineffective or the booster pump is deemed to be ineffective, along with a fault in the phasing of the high-pressure fuel injection pump or a fault in learning the phasing of this pump.

10. The method as claimed in claim 3, wherein said initial base pressure in the one of the high-pressure fuel tank or the common rail is substantially equal to a pressure of the booster pump.

* * * * *